United States Patent [19]

McPhalen

[11] Patent Number: 4,905,427

[45] Date of Patent: Mar. 6, 1990

[54] MULTI-PURPOSE UNIVERSAL FIT ROOF-RAIN GUTTER PROTECTION SYSTEM

[76] Inventor: Peter M. McPhalen, No. 78 - 4900 Cartier St., Vancouver, B. C., Canada, V6M 4H2

[21] Appl. No.: 255,669

[22] Filed: Oct. 11, 1988

[30] Foreign Application Priority Data

Jun. 10, 1980 [CA] Canada ..... 569249

[51] Int. Cl.[4] ..... E04D 13/00; E04D 3/40; E04B 7/00

[52] U.S. Cl. ..... 52/12; 248/48.1; 210/474

[58] Field of Search ..... 248/48.1, 48.2; 52/11, 52/12, 15, 16; 210/474

[56] References Cited

U.S. PATENT DOCUMENTS

| | | | |
|---|---|---|---|
| 669,495 | 3/1901 | Babcock | 248/48.1 |
| 2,175,521 | 10/1939 | Fry | 52/12 |
| 2,219,953 | 10/1940 | Fry | 52/12 |
| 3,436,878 | 4/1969 | Singer | 248/48.2 |
| 3,741,398 | 6/1973 | Abramson | 210/474 |
| 3,864,267 | 2/1975 | Nelems | 210/474 |
| 4,247,397 | 1/1981 | Dobosi | 210/162 |
| 4,311,292 | 1/1982 | Deason | 52/11 |
| 4,351,134 | 9/1982 | Clarkson | 52/12 |
| 4,395,852 | 8/1983 | Tang | 52/12 |
| 4,404,775 | 9/1983 | Demartini | 52/12 |
| 4,406,093 | 9/1983 | Good et al. | 52/11 |
| 4,411,110 | 10/1983 | Carey | 52/11 |
| 4,418,504 | 12/1983 | Lassiter | 52/12 |
| 4,435,925 | 3/1984 | Jefferys | 52/12 |
| 4,455,791 | 6/1984 | Elko et al. | 52/12 |
| 4,573,290 | 4/1986 | Felming | 52/12 |
| 4,586,298 | 5/1986 | Colp | 52/12 |
| 4,590,716 | 5/1986 | Smith | 52/12 |
| 4,592,174 | 6/1986 | Hileman | 52/12 |
| 4,604,837 | 8/1986 | Beam | 52/12 |
| 4,607,465 | 8/1986 | Hopkins | 52/12 |
| 4,631,875 | 12/1986 | Olson | 52/12 |
| 4,644,704 | 2/1987 | Pedgonay | 52/12 |
| 4,667,448 | 5/1987 | Smith | 52/12 |

FOREIGN PATENT DOCUMENTS

| | | | |
|---|---|---|---|
| 561877 | 3/1984 | Australia . | |
| 529684 | 7/1954 | Belgium | 52/633 |
| 548902 | 7/1956 | Belgium | 52/633 |
| 734648 | 5/1966 | Canada | 52/12 |
| 1026078 | 4/1978 | Canada . | |
| 1189280 | 6/1985 | Canada . | |
| 718521 | 11/1954 | United Kingdom | 52/633 |
| 843286 | 8/1960 | United Kingdom | 52/633 |

*Primary Examiner*—James L. Ridgill, Jr.

*Attorney, Agent, or Firm*—Poms, Smith, Lande & Rose

[57] ABSTRACT

This invention relates to a multi-purpose universal fit roof-rain gutter protection system which is useful in keeping debris out of roof-rain gutters and drain spouts. The roof-rain gutter shield comprises an elongated resilient weather-proof planar sheet which has a linear gutter lip engaging inverted "L" surface along one of its elongated sides and on the opposite elongated side, has a plurality of fingers extending in series perpendicularly from the edge of the sheet. The sheet has in the central area a plurality of elongated openings arranged in rows and extending laterally along the sheet relative to the length of the sheet. The sheet may also have a series of auxiliary openings between the inverted "L" surface and the central area openings.

11 Claims, 5 Drawing Sheets

MULTI-PURPOSE UNIVERSAL FIT ROOF-RAIN GUTTER PROTECTION SYSTEM

FIELD OF THE INVENTION

This invention relates to a multi-purpose universal fit roof-rain gutter protection system which is useful in keeping debris out of roof-rain gutters and drain spouts.

BACKGROUND OF THE INVENTION

Roof rain gutters, which are installed around the eaves of houses, buildings and the like for the purpose of collecting rain and melted snow, hail or ice which runs off the roof of the building and directing the rain, melted snow, hail or ice to a drain spout system, are in common use in building constructions in most parts of the civilized world. One of the problems with the roof-rain gutter system is that with time, the gutter becomes plugged due to accumulation of leaves, dirt, twigs, tree seed pods, needles and the like. Such debris, unless periodically cleaned from the roof-rain gutter system, will impede water flow and eventually plug the drain spout of the roof-rain gutter. As a consequence, the roof-rain gutter will ultimately overflow. In some cases, usually in commercial buildings, depending upon the design of the roof-rain gutter and drainage system, debris can plug the system to the point that water will back up and enter the building, thereby resulting in water damage.

A number of solutions to the roof-rain gutter debris accumulation problem have been suggested in the past. Australian Pat. No. 561877, sealed Oct. 28, 1987, Hopkins, discloses a leaf excluder to be used with a rain water guttering of channel form. The leaf excluder is constructed of an elongated strip of flexible resilient sheet material with a plurality of gutter engaging fingers along one edge thereof. The strip also includes a plurality of water passing slots in the strip. The strip, in upwardly arcuate form, is positioned along the length of the rain guttering and causes leaves and other debris to flow over the top of the rain guttering, while the majority of the rain water passes through the slots in the elongated strip. Any leaves or other debris which remain on the top of the strip will ultimately dry out and be blown away by the wind. A problem with the Hopkins strip is that in its principal embodiment, there is nothing which will resist downward depression of the strip into the roof rain gutter. The weight of the strip is supported strictly by upwardly arcuate tension force. Consequently, heavy debris, hail, snow or ice can collapse the strip.

Canadian Pat. No. 1,026,078, issued Feb. 14, 1978, Zukauskas, discloses a shield configuration (see FIG. 8) which has an abrupt forward edge which separates leaf and water flows in rain gutters. A space between a forward surface of the shield and a forward wall of the rain gutter receives water. This system requires clips for installation.

Canadian Pat. No. 1,189,280, issued June 25, 1985, Tanski, discloses a roof and gutter saving device which includes in combination an elongated central main body, a tongue portion along one longitudinal edge of the central main body and a non-rigid joint formed along the longitudinal edges pivotally hinging the tongue portion, the overhang portion and a stabilizing tab. The main purpose of this device is to protect gutters of houses from becoming ice filled during the winter and being pulled away from the roof. This device does not appear to be designed to hold debris out of the roof-rain gutter. Also, installation is complicated.

A number of other U.S. patents illustrate various designs of protectors for roof-rain gutter systems:

| U.S. Pat. No. | Inventor | Issue Date |
|---|---|---|
| 3,741,398 | Abramson | June, 1978 |
| 4,247,397 | Dobosi | January, 1981 |
| 4,311,292 | Deason | January, 1982 |
| 4,404,775 | Demartini | September, 1983 |
| 4,406,093 | Good et al. | September, 1983 |
| 4,411,110 | Carey | October, 1983 |
| 4,418,504 | Lassiter | December, 1983 |
| 4,435,925 | Jefferys | March, 1984 |
| 4,455,791 | Elko et al. | June, 1984 |
| 4,573,290 | Fleming | March, 1986 |
| 4,586,298 | Colp | May, 1986 |
| 4,590,716 | Smith | May, 1986 |
| 4,604,837 | Beam | August, 1986 |
| 4,631,875 | Olson | December, 1986 |
| 4,644,704 | Pedgonay | February, 1987 |
| 4,667,448 | Smith | May, 1987 |

SUMMARY OF THE INVENTION

The invention pertains to a roof-rain gutter shield comprising an elongated resilient weather-proof planar sheet which has a linear rain gutter lip engaging inverted "L" surface along one of its elongated sides and on the opposite elongated side has a plurality of fingers extending in series perpendicularly from the edge of the sheet, and a plurality of elongated openings in the central area of the sheet.

In the shield as defined, the elongated openings may be linear or oval in shape and may be disposed in parallel rows with one another, the rows extending laterally across the central area of the sheet. Alternatively, the openings may be in the shape of inverted "V"'s arranged in parallel rows extending laterally across the central area of the sheet, or arranged in a herring-bone pattern in alternating groups of two parallel rows of openings angled in one direction and two parallel rows of openings angled in the opposite direction, all rows extending in parallel laterally across the central area of the sheet, or in the shape of alternating rows of upright "S" shape openings, and reclining "S" shape openings, the upright "S" and reclining "S" shape openings extending in alternating parallel rows laterally across the central area of the sheet surface.

In the shield as defined, a plurality of elongated openings may be formed in the sheet between the openings in the central area of the sheet, and the inverted "L" edge of the sheet opposite the edge of the sheet bearing the plurality of fingers.

DRAWINGS

In the drawings which depict specific embodiments of the invention but which should not be construed as restricting the scope or spirit of the invention in any way:

DETAILED DESCRIPTION OF SPECIFIC EMBODIMENTS OF THE INVENTION

Figure 1:
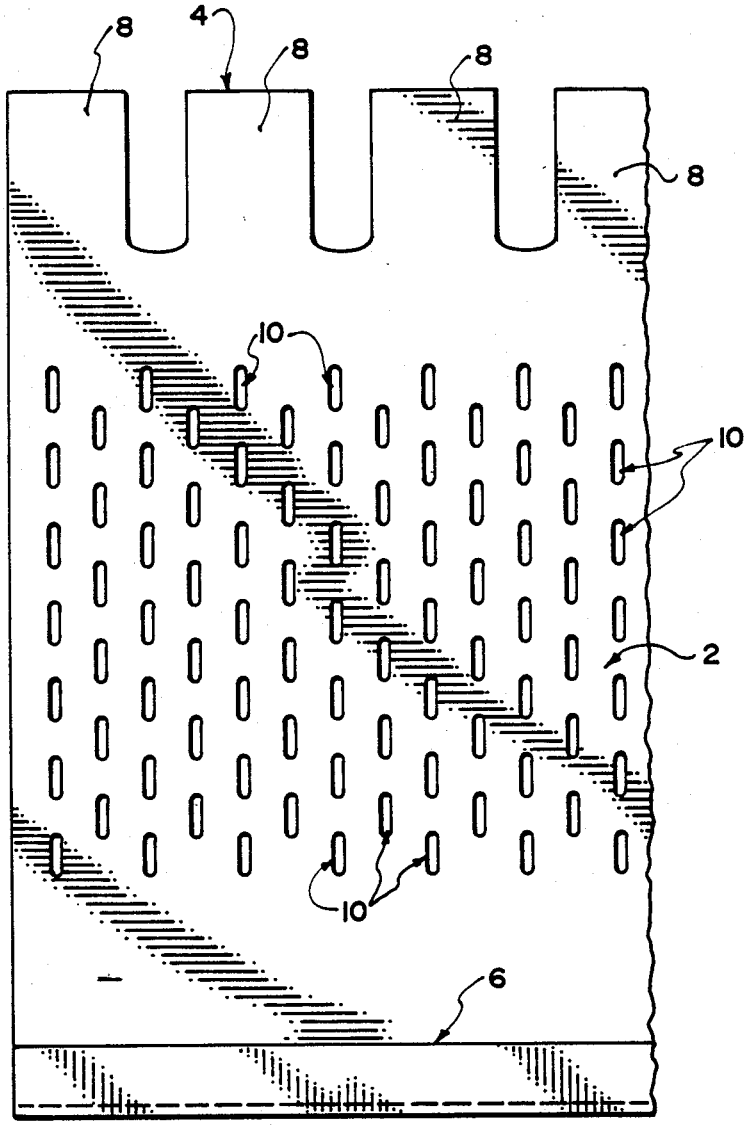
FIG. 1 illustrates a roof-rain gutter shield with a series of oval rain openings therein.

Referring to the drawings, FIG. 1 illustrates a plan view of one design of shield 2. The shield 2 is constructed of an elongated strip of weather-proof resilient plastic material such as polyvinyl chloride. The shield 2 should be made of flexible waterproof material which has a certain amount of spring to it. This enables the shield 2 to be installed in the roof-rain gutter in an upwardly arcuate orientation (see FIG. 6). The elongated shield 2 has a rear edge 4 running along one side, and a front inverted "L" edge 6 running along the opposite side. Formed in, and extending perpendicularly from the rear edge 4 are a plurality of fingers 8 which have openings therebetween. These fingers 8 extend the length of the rear edge 4. The front edge 6, in the embodiment illustrated in FIG. 1, is an inverted "L" shape and does not have any openings or recessions therein. Located in the central area of the shield 2 are a large number of oval-shaped rain openings 10 arranged in parallel rows, and extending laterally relative to the length of the shield 2.

Figure 2:
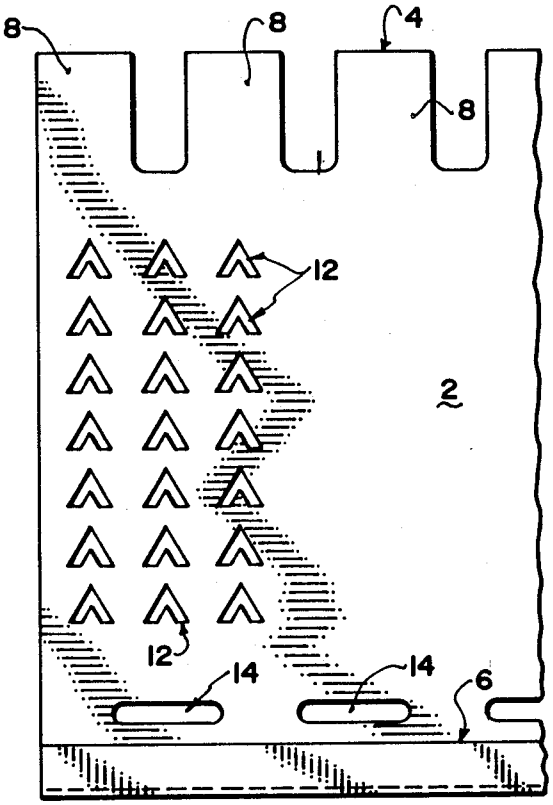
FIG. 2 illustrates a roof-rain gutter shield with a series of inverted "V" rain openings therein.

FIG. 2 illustrates a plan view of an alternative design of shield 2. This design differs somewhat from the design illustrated in FIG. 1 in that instead of oval-shaped rain openings, the rain openings are a series of inverted "V" openings 12 arranged in parallel rows and extending laterally across the central area of the shield 2. As with the embodiment illustrated in FIG. 1, the shield 2 has a rear edge 4 and a front inverted "L" edge 6, with a plurality of perpendicularly extending fingers 8 disposed along the rear edge 4 of the shield 2. FIG. 2 also illustrates a series of elongated oval-shaped openings 14, which extend along the length of the shield 2, between the front inverted "L" edge 6 and the plurality of inverted "V"-shaped openings 12 in the central area of the shield 2. The purpose of the series of openings 14 is to provide additional rain passage through the shield 2, if required.

It will be recognized by those skilled in the art that the size of the oval-shaped openings 10 shown in FIG. 1 or the inverted "V"-shaped openings 12, and linear openings 14 shown in FIG. 2, can be increased or decreased as required in order to accommodate the level of precipitation that occurs in the areas in which the specific shields 2 are installed in roof-rain gutters of buildings in such areas.

Figure 3:
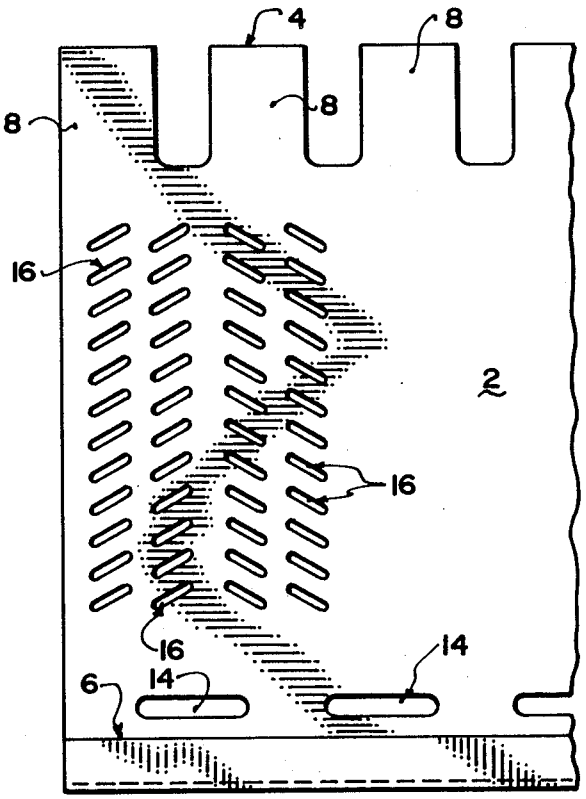
FIG. 3 illustrates a roof-rain gutter shield with a series of oval openings therein arranged in a herring-bone pattern.
Figure 5:
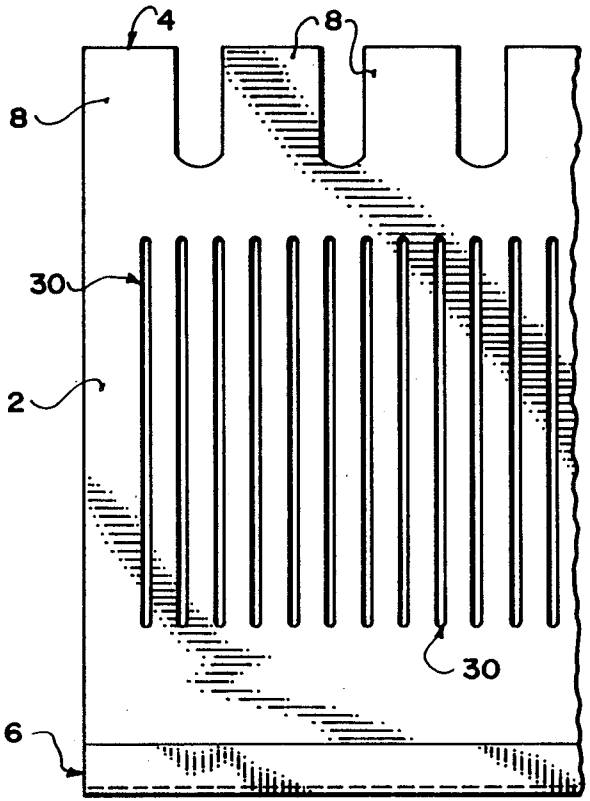
FIG. 5 illustrates a roof-rain gutter shield with a parallel series of elongated slots extending laterally across the protector.
Figure 4:
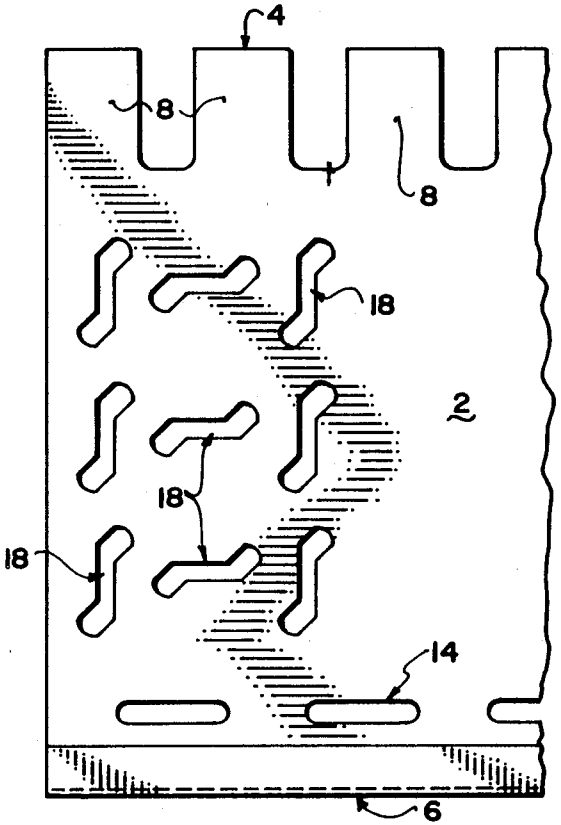
FIG. 4 illustrates a roof-rain gutter shield with a series of "S" shaped openings therein.

FIG. 3 illustrates a plan view of an alternative design of shield 2 wherein the central openings consist of a plurality of oval openings 16, which are arranged in a "herring-bone" pattern. The shield 2 illustrated in FIG. 3 also includes a linear series of oval-shaped openings 14 extending along the shield 2 between the central-area openings 16 and the front inverted "L" edge 6 of the shield 2. FIG. 4 illustrates a further embodiment of the invention wherein the centrally disposed rain openings 18 have an "S" shape. The "S"-shaped openings are arranged in upright alternating rows and in a reclining orientation. FIG. 5 illustrates a further embodiment of the invention where elongated slots 30 extend laterally and in parallel orientation across a major portion of the central area of the shield 2.

It will be recognized that other designs of openings can be formed in the shield 2, according to the opening design that is optimum for excluding the particular type of debris and permitting passage of precipitation that may occur in any designated area where the particular shield 2 is installed.

Parallel rows of openings 10, as illustrated in FIG. 1, may be optimum in those areas where the precipitation typically falls in the form of rain, and there is little snow precipitation. Thus, there is little danger that the small oval-shaped openings 10 will plug up due to icing. In the shield embodiment illustrated in FIG. 2, the openings in the form of inverted "V"'s 12 are better suited to withstand icing problems. The "herring-bone" arranged openings 16 shown in FIG. 3 tend to cause the rain to concentrate in parallel rivulets as the rain travels laterally across the shield 2. By concentrating the rain into rivulets, the herring-bone arrangement of openings 16 tend to have greater leaf carrying capacity, particularly when leaf debris is abundant in the autumn. The alternating upright and reclining "S"-shaped openings 18 depicted in FIG. 4 are generally fairly large in size, and therefore individually have more rain carrying capacity. Thus, it is not necessary to have as large a number of openings as in the shield designs illustrated in FIGS. 1, 2 and 3. Also, the "S"-shaped openings 18 in FIG. 4 tend not to ice-up in the winter time as readily as smaller shaped openings The design illustrated in FIG. 5 has the advantage that it is relatively economical to produce and is suitable for use in those areas where icing or heavy leaf loads are not encountered.

Figure 6:
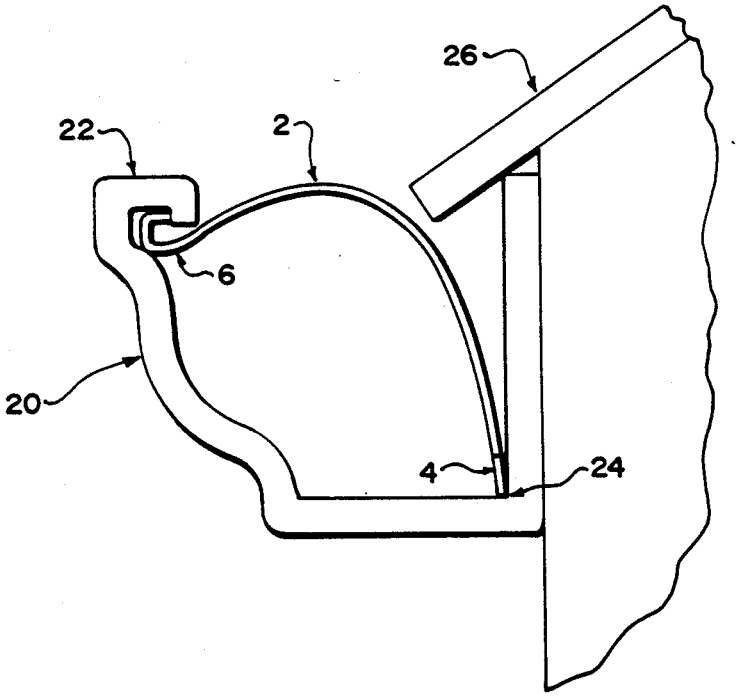
FIG. 6 illustrates an end elevation view of the gutter shield installed in a roof-rain gutter.

FIG. 6 illustrates in end elevation view the manner in which the shield 2 is installed in a conventional roof-rain gutter 20. The roof-rain gutter 20 has an inwardly extending lip 22 at the upper front edge of the gutter 20, and a right angled rear lower corner 24, at the rear base of the roof-rain gutter 20. This design of roof-rain gutter 20 is fairly common throughout North America. The front lip 22 extends inwardly and ultimately downwardly to enhance appearance and avoids having a sharp edge occur at the upper front area of the roof-rain gutter 20. The design of the front lip 22 provides a ready location for accommodating the front inverted "L" edge 6 of the shield 2. The rear edge 4, with fingers 8, extends down into the rear lower corner 24. By extending and fitting into the underside of the front lip 22, and resting on the ridge formed in the front face of the roof-rain gutter 20, the front inverted "L" edge 6 of the shield 2 interlocks with the interior of the lip 22 and is fully supported against any weight which the shield 2 may bear, for example, leaves, snow, hail, ice and the like. The upwardly bowed orientation of the shield 2 adds additional support, thereby providing considerable strength and resistance to collapse of the shield 2 into the interior of the roof-rain gutter 20. The fingers 8 at the rear edge of the shield 2 grip the rear lower corner 24 of the gutter 20 and accommodate bends or distortions along the length of in the rear lower corner 24 of the gutter 20, when it is installed in a typical roof edge location.

Figure 7:
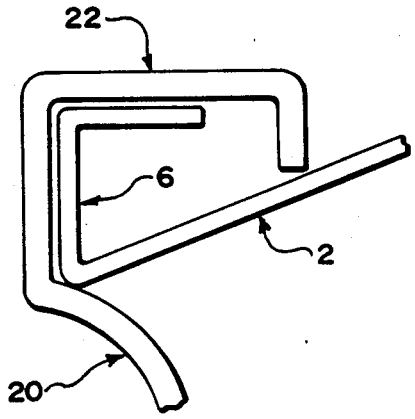
FIG. 7 illustrates a detailed end elevation view of the inverted "L" edge of the shield interlocking with the front lip of a roof-rain gutter.

FIG. 7 illustrates in detailed end elevation view the manner in which the inverted "L" edge 6 of the shield 2 interlocks with the front lip 22 of the gutter 20 to provide support for the shield 2 against the weight of ice and debris.

The inverted "L" edge 6 can be modified in shape such as being lengthened or shortened in either of the "L" dimensions or formed into a curled shape to accommodate variations in the design of the front lip 22 of the gutter 20.

Figure 8:
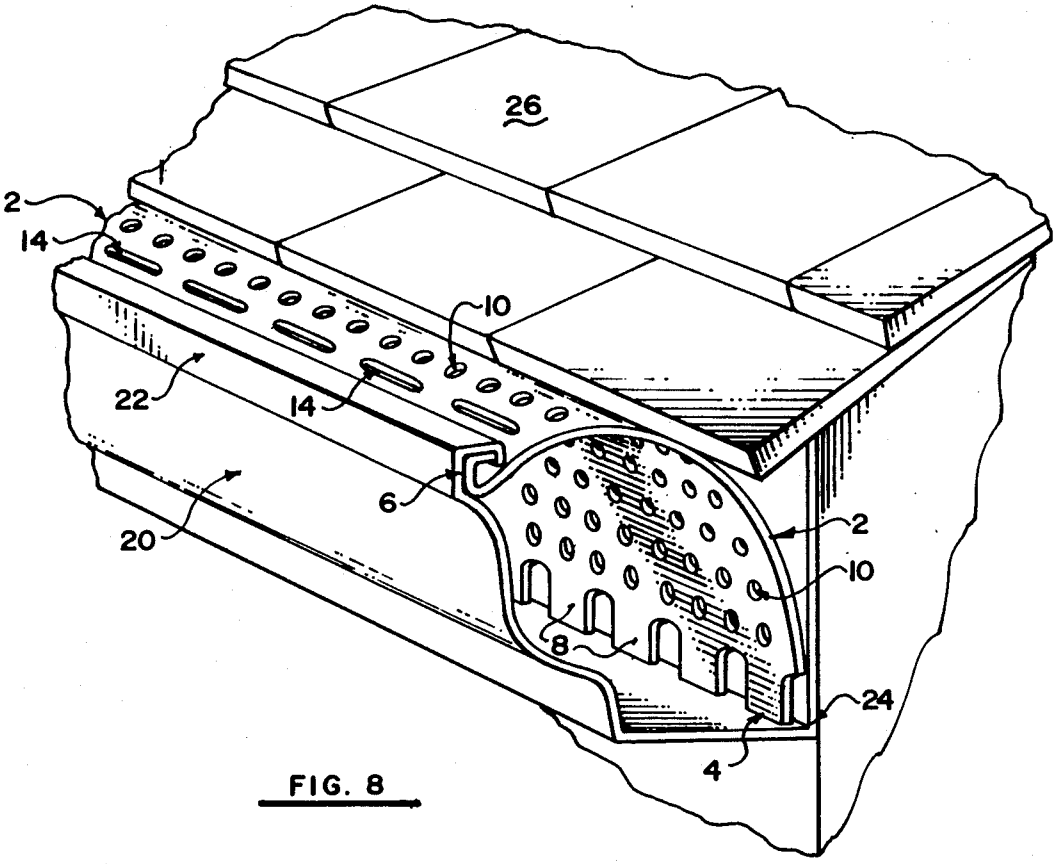
FIG. 8 illustrates a perspective view of the gutter shield secured in place in a roof-rain gutter.

FIG. 8 illustrates in perspective view the manner in which the shield 2 is installed in a roof-rain gutter 20 in an upwardly curved manner. The front inverted "L" edge 6 extends under and interlocks with the front lip 22 of the gutter 20, while the plurality of fingers 8 extend into the lower rear corner 24 of the gutter 20. Shingles 26 are installed on the roof in conventional manner. In the shield design illustrated in FIG. 8, the shield 2 has a plurality of oval-shaped openings 10 arranged in parallel linear series. As can be seen in FIG. 8, the shield 2 at the top region extending between the shingles 26 and the front lip 22 provides a smooth even surface which promotes deflection of the rain water into the interior of the gutter 20 through the openings 10, while at the same time encouraging passage of debris such as leaves, dirt, tree seed pods, twigs, needles, and the like, across the top end of the shield 2 and over the front lip 22 of the gutter 20.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A roof-rain gutter shield for use in association with a rain gutter having a first upstanding vertical side wall connecting to the roof of a house or the like and a second upstanding vertical side wall spaced from said first side wall, a bottom planar wall interconnecting said side walls, a rear corner being formed at the intersection of said first side wall and said bottom planar wall, said rain gutter being open at the top, said second side wall terminating at the top in an elongated lip extending along its length, said shield comprising an elongated resilient weather-proof planar sheet which is adapted to be curved into an upwardly convex arcuate shape in a rain gutter; which sheet has a rain gutter upper lip engaging edge which is bent back upon itself and is adapted to engage both the interior of the elongated lip of the second side wall of the rain gutter and the opposite first side wall, said sheet having a plurality of spaced fingers extending laterally in series from the edge of the sheet adapted to engage the rear corner of the rain gutter, and having a plurality of openings in the central area of the sheet.

2. A shield as defined in claim 1 wherein when the gutter shield is installed in a rain gutter, the fingers abut the rear face of the rain gutter.

3. A shield as defined in claim 1 wherein the arched midregion of the gutter shield, when installed in a rain gutter, abuts a joist or a roof support underlying weather-proof roof covering overhanging the rain gutter.

4. A shield as defined in claim 1 wherein the openings are of oval shape and are disposed in parallel rows with one another, the rows extending laterally across the central area of the sheet.

5. A shield as defined in claim 1 wherein the openings are in the shape of inverted "V"'s arranged in parallel rows extending laterally across the central area of the sheet.

6. A shield as defined in claim 1 wherein the openings are oval in shape and are arranged in a herring-bone pattern in alternating groups of two parallel rows of openings angled in one direction and two parallel rows of openings angled in the opposite direction, all rows extending in parallel laterally across the central area of the sheet.

7. A shield as defined in claim 1 wherein the openings are in the shape of alternating rows of upright "S" shape openings, and reclining "S" shape openings, the upright "S" and reclining "S" shape openings extending in alternating parallel rows laterally across the central area of the sheet.

8. A shield as defined in claim 1 wherein the openings are elongated slots which are disposed in parallel rows with one another and extend laterally across the central area of the sheet.

9. A shield as defined in claim 1, 4 or 5 wherein a plurality of openings are formed in the sheet between the openings in the central area of the sheet, and the bent back upon itself edge of the sheet opposite the edge of the sheet bearing the plurality of fingers.

10. A shield as defined in claim 6, 7 or 8 wherein a plurality of openings are formed in the sheet between the openings in the central area of the sheet, and the bent back upon itself edge of the sheet opposite the edge of the sheet bearing the plurality of fingers.

11. A shield for use in conjunction with a rain gutter attached to the roof of a house or the like, the rain gutter having a first upstanding side wall attached to the roof, a second upstanding side wall spaced from the first side wall and a bottom planar wall interconnecting the spaced side walls, said second side wall having an elongated lip along the upper edge thereof, said shield comprising:

an elongated resilient weather-proof planar sheet of a material curved into an upwardly convex arcuate shape having a first side portion abutting against said first side wall, a curved upper wall portion integral with said first side portion extending to and terminating at said lip, said curved upper wall portion having an integral lip engaging edge bent back upon itself engaging the said lip thereby retaining said shield in said gutter, said first side portion having a plurality of spaced elongated fingers with openings therebetween, and said curved wall portion having a plurality of spaced openings therethrough.

* * * * *